US009345304B2

(12) United States Patent
Lott et al.

(10) Patent No.: US 9,345,304 B2
(45) Date of Patent: May 24, 2016

(54) NOZZLE FOR APPLYING A POWDER

(75) Inventors: Manfred Lott, Darmstadt (DE); Dirk Weichaus, Bickenbach (DE)

(73) Assignee: KAO Germany GmbH, Darmstadt (DE)

( * ) Notice: Subject to any disclaimer, the term of this patent is extended or adjusted under 35 U.S.C. 154(b) by 0 days.

(21) Appl. No.: 13/512,923

(22) PCT Filed: Dec. 13, 2010

(86) PCT No.: PCT/EP2010/069542

§ 371 (c)(1),
(2), (4) Date: Jul. 25, 2012

(87) PCT Pub. No.: WO2011/073150

PCT Pub. Date: Jun. 23, 2011

(65) Prior Publication Data

US 2012/0279993 A1 Nov. 8, 2012

(30) Foreign Application Priority Data

Dec. 14, 2009 (EP) ..... 09179114

(51) Int. Cl.
*B67D 7/76* (2010.01)
*A45D 33/02* (2006.01)
*A45D 19/02* (2006.01)

(52) U.S. Cl.
CPC ..... *A45D 33/02* (2013.01); *A45D 19/02* (2013.01)

(58) Field of Classification Search
CPC ..... B65D 83/06; B65D 37/00; B67D 7/78; B67D 7/76; B05B 11/02; A45D 33/02; A45D 19/0008; A45D 19/02; A61M 11/02; A61M 2202/064
USPC ..... 222/189.02, 189.03, 189.06, 189.04, 222/206, 631–633
See application file for complete search history.

(56) References Cited

U.S. PATENT DOCUMENTS 2,896,825 A 7/1959 Jackson
3,841,530 A * 10/1974 Janninck ..... 222/189.04
(Continued)

FOREIGN PATENT DOCUMENTS

EP 2 070 833 A1 6/2009
GB 524 283 A 8/1940
WO 2005/072700 A2 8/2005
WO WO 2005072700 A2 * 8/2005 ..... A61K 9/00
WO 2006/130956 A1 12/2006

OTHER PUBLICATIONS

Merriam-Webster—Sift; Merriam-Webster.com Mar. 7, 2014.*
(Continued)

*Primary Examiner* — J. Casimer Jacyna
*Assistant Examiner* — Benjamin R Shaw
(74) *Attorney, Agent, or Firm* — Norris McLaughlin & Marcus, P.A.

(57) ABSTRACT

It is provided a nozzle (10) for applying a powder, particularly a pulverized hair treatment product, particularly preferred a cosmetic and/or dermatological product, comprising a cap (12) for being connected to a squeezable container for storing the powder, an outlet conduit (14) protruding from the cap (12) along an axial direction (16) for dispensing the powder through the cap (12). According to the invention a mesh (28) covering the outlet conduit (14) for retaining the powder and for pulverizing powder agglomerates is provided, wherein the mesh (28) comprises in a region covering the outlet conduit passages, and the outlet conduit (14) comprises an inner surface (22) for guiding the powder, wherein the inner surface (22) is inclined with respect to the axial direction (16) of the outlet conduit (14) by an angle $\alpha$ of $0.0° < \alpha < 15.0°$, particularly $1.0° < \alpha < 12.5°$, preferably $1.5° < \alpha < 8.0°$, further preferred $2.0° < \alpha < 7.0°$, more preferred $2.5° < \alpha < 6.0°$ and most preferred $\alpha = 3.0° \pm 0.2°$.

22 Claims, 3 Drawing Sheets

(56) References Cited

U.S. PATENT DOCUMENTS

Figure 1:
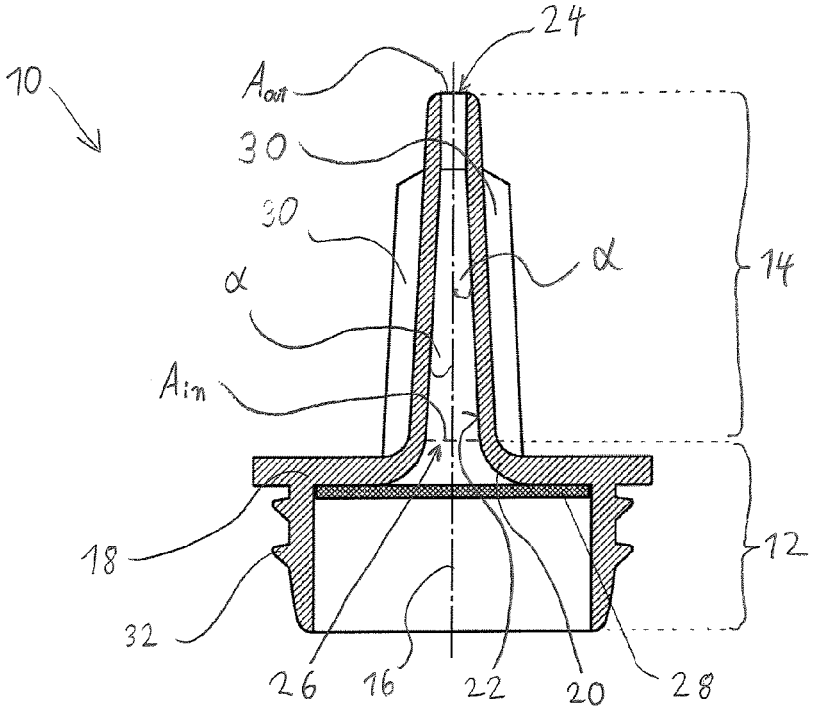

| | | | | |
|---|---|---|---|---|
| 4,017,007 | A * | 4/1977 | Riccio | 222/80 |
| 4,602,651 | A | 7/1986 | Roppatte, Jr. | |
| 5,725,131 | A * | 3/1998 | Bell et al. | 222/196 |
| 6,024,141 | A * | 2/2000 | Wegman | 141/59 |
| 2005/0145651 | A1* | 7/2005 | Katefidis et al. | 222/145.5 |
| 2006/0272108 | A1* | 12/2006 | Stern et al. | 8/406 |
| 2007/0193646 | A1* | 8/2007 | Tapphorn et al. | 141/2 |
| 2009/0152281 | A1* | 6/2009 | Bowes et al. | 220/694 |

OTHER PUBLICATIONS

ASTM International, Designation: E11-13, Standard Specification for Woven Wire Test Sieve Cloth and Test Sieves, Jul. 2014, pp. 3-4.*

International Search Report Dated Mar. 7, 2011, Mailed Mar. 14, 2011.

* cited by examiner

NOZZLE FOR APPLYING A POWDER

This application is a 371 application of PCT/EP2010/069542 filed Dec. 13, 2010, which claims foreign priority benefit under 35 U.S.C. §119 of European Application No. 09179114.5 filed Dec. 14, 2009.

The invention relates to a nozzle, by means of which a powder, particularly a hair treatment product can be applied.

From EP 2 070 833 A1 a nozzle is known, by means of which a solution and/or dispersion can de dispensed. It is not mentioned that this nozzle is suitable for dispensing a liquid free composition, like powder. The nozzle comprises a cap from which an outlet conduit protrudes communicating through the cap with a container. The outlet conduit comprises at its distal end a distal duct with constant diameter. The distal duct is connected via a radially outwards step to a proximal duct comprising an inner surface which is inclined to an axial direction of the outlet conduit by an angle $\alpha$ of about 8°. At its proximal end the outlet conduit is covered by a perforated plate, wherein the passages of the perforated plate are significantly spaced to each others. The passages comprise a diameter d of 0.5 mm≤d≤5.0 mm for retaining large particles.

It is a disadvantage of such kind of a nozzle that the nozzle can not be used for applying a powder due to the risk of clogging inside the outlet conduit. Further there is a permanent need that the particle sizes of applied powder particles are as homogenous as possible.

It is an object of the invention to provide a nozzle, by means of which the risk of clogging is reduced, when a powder is dispensed, and a homogenous particle size distribution of the dispensed powder particles is given.

The object is achieved by the features of claim 1. Preferred embodiments are given by the dependent claims.

The nozzle according to the invention for applying a powder, particularly a pulverized hair treatment product, particularly preferred a cosmetic and/or dermatological product, comprises a cap for being connected to a squeezable container for storing the powder, an outlet conduit protruding from the cap along an axial direction for dispensing the powder through the cap. According to the invention a mesh covering the outlet conduit for retaining the powder and for pulverizing powder agglomerates is provided, wherein the mesh comprises in a region covering the outlet conduit passages, and the outlet conduit comprises an inner surface for guiding the powder, wherein the inner surface is inclined with respect to the axial direction of the outlet conduit by an angle $\alpha$ of $0.0° < \alpha \leq 15.0°$, particularly $1.0° \leq \alpha \leq 12.5°$, preferably $1.5° \leq \alpha \leq 8.0°$, further preferred $2.0° \leq \alpha \leq 7.0°$, more preferred $2.5° \leq \alpha \leq 6.0°$ and most preferred $\alpha = 3.0° \pm 0.2°$. The nozzle is particularly used for applying a non-therapeutic product.

Due to the mesh powder agglomerates can be pulverized ensuring a very fine powder with small particle sizes. Since the mesh not only retains the powder particles but also pulverizes powder agglomerates, a homogenous particle size distribution of the dispensed powder particles can be ensured. The conduits of the mesh are arranged at least in the region covering the outlet conduit, this means in a region bordered by the axial projection of the edge of the maximum flow cross-section of the outlet conduit. It is possible that several conduits of the mesh may be positioned outside the region covering the outlet conduit, for example in the case of a woven mesh with a larger area than the maximum flow cross-section of the outlet conduit passage. Due to the small inclination angle $\alpha$ a steep course of the inner surface of the outlet conduit is given leading to an additional volume between the mesh and the outlet opening of the outlet conduit, where the flow of the powder particle may be homogenized to a nearly laminar flow. The risk that powder particles may hit each other and may agglomerate after passing the mesh is reduced. Further the steep course of the outlet conduit leads to an increased flow velocity at a reduced risk of accumulations and agglomerations of the powder particles. Due to the reduced amount of agglomerations inside the outlet conduit the risk of clogging is reduced when a powder is dispensed. This leads in turn to a wide spraying effect. Due to the reduced amount of agglomerations of the dispensed powder particles it is possible to cover a wider surface with a lower mass of powder. The mesh comprises passages which are spaced to each other by such a small distance that the mesh is able to pulverize powder agglomerates. By means of the steep inclination of the outlet conduit it is prevented that the finely pulverized powder agglomerates stick together again. Due to the combination of the mesh designed for pulverizing powder agglomerates and the steep inclination of the outlet conduit it is enabled to apply a very fine powder which does not agglomerate significantly until it is applied to the intended target, for instance to human hair.

The mesh is particularly a web of woven wires. The wires are particularly made from a metal and/or plastic material. Particularly the sum $A_P$ of the areas of the passages of the mesh is higher than the sum $A_M$ of the areas of the parts between the passages in flow direction, this means axial direction of the outlet conduit, at least in the region, where the mesh covers the outlet conduit. Preferably the ratio $A_P/A_M$ is $1 \leq A_P/A_M \leq 100$, particularly $2 \leq A_P/A_M \leq 50$, preferably $3 \leq A_P/A_M \leq 10$ and most preferred $4 \leq A_P/A_M \leq 5$. The thickness t of the mesh in axial direction is particularly 0.02 mm≤t≤10.0 mm, preferably 0.05 mm≤t≤5.0 mm, particularly preferred 0.1 mm≤t≤4.0 mm and most preferred 0.5 mm≤t≤2.0 mm. The passages can be of mainly identical shape or differently shaped, like circular, elliptic, rectangular, slot-like and/or quadratic. The different passages can comprise a mainly identical or different hydraulic diameter. The passages can be regularly and/or irregularly distributed at different parts of the mesh. By considering the hydraulic diameter the effect of a non-circular cross section of a passage to the flow of powder particles can be described by means of a diameter of an equivalent circular cross section for the respective passage. For calculating the hydraulic diameter it is assumed that the whole perimeter of the cross section of the respective passage is the wetted perimeter. Particularly the cap comprises an inner or outer thread for being screwed onto the squeezable container. If so, a sealing can be provided between the cap and the container. When the squeezable container is pressed the powder located inside the container is pressed through the mesh and dispensed via the outlet conduit through the cap. Particularly the outlet conduit and the cap are one-piece, preferably made by plastic injection molding. Due to the inclined outlet conduit a channel through the cap along the outlet conduit can be easily provided by the mould itself without the need for a separated core. Particularly in order to prevent sharp corners between the cap and the outlet conduit inside the nozzle an inlet curvature at the transition between the cap and the inner surface of the outlet conduit can be provided. In this case it is understood that the proximal end of the outlet conduit is located at the change between the inlet curvature and the mainly linear course of the inner surface of the outlet conduit. This means the inlet curvature is disregarded for defining the design of the outlet conduit, particularly with respect to the measurement of the angle $\alpha$. The part of the nozzle in its axial extension comprising the inlet curvature is regarded as part of the cap.

Particularly the inner surface of the outlet conduit is stepless inclined with respect to the axial direction of the outlet conduit and comprises a constant angle α. This prevents dead water zones and a sudden change of the flow velocity inside the outlet conduit. Mainly straight flow lines for the powder particle inside the outlet conduit are ensured so that the risk of an accumulation and agglomeration of powder particles is reduced.

Preferably the outlet conduit comprises at its distal end an outlet opening comprising a cross sectional area of $A_{out}$ and at its proximal end an inlet opening comprising a cross sectional area of $A_{in}$, wherein in the case of a present inlet curvature the inlet opening is located at a change between the inlet curvature and a mainly linear course of the inner surface of the outlet conduit, wherein the ratio between $A_{out}$ and $A_{in}$ is $0.0 \leq A_{out}/A_{in} \leq 1.0$, particularly $0.05 \leq A_{out}/A_{in} \leq 0.8$, preferably $0.1 \leq A_{out}/A_{in} \leq 0.6$, more preferred $0.15 \leq A_{out}/A_{in} \leq 0.5$ and most preferred $0.2 \leq A_{out}/A_{in} \leq 0.3$. By means of this ratio of the outlet opening to the inlet opening the flow lines of the powder particles can be bundled and the powder particles accelerated without a significant increase of the risk of agglomerated powder particles. The cross sectional areas of the inlet opening and/or of the outlet openings are particularly circular or elliptic for preventing dead water zones.

Particularly preferred the outlet conduit comprises at its distal end an outlet opening comprising a hydraulic diameter $d_{out}$ of 0.3 mm$\leq d_{out} \leq$2.0 mm, particularly 0.5 mm$\leq d_{out} \leq$1.5 mm, preferably 0.7 mm$\leq d_{out} \leq$1.3 mm and most preferred $d_{out}$=1.0 mm±0.1 mm. By considering the hydraulic diameter the effect of a non-circular cross section of the outlet conduit can be described by means of a diameter of an equivalent circular cross section for the respective passage. For calculating the hydraulic diameter it is assumed that the whole perimeter of the cross section of the outlet conduit is the wetted perimeter. The cross section of the outlet conduit can be for instance circular, elliptical or angular. This hydraulic diameter of outlet opening is narrow enough for providing a wide spray effect for the dispensed powder. At the same time the hydraulic diameter of outlet opening is wide enough for preventing a clogging of the outlet conduit. A too high volume fraction of powder particles in the cross section of the outlet opening is prevented.

In a preferred embodiment each of the passages of the mesh in the region covering the outlet conduit comprises a hydraulic diameter d of 0.01 mm≤d≤0.45 mm, particularly 0.10 mm≤d≤0.40 mm, preferably 0.20 mm≤d≤0.30 mm and most preferred d=0.25 mm±0.02 mm. By considering the hydraulic diameter the effect of a non-circular cross section of the passages can be described by means of a diameter of an equivalent circular cross section for the respective passage. For calculating the hydraulic diameter it is assumed that the whole perimeter of the cross section of the respective passage is the wetted perimeter. The cross section of the respective passage can be for instance circular, elliptical, angular or rectangular, particularly square-like. Due to this quite small hydraulic diameter of the passages of the mesh it is prevented that the powder may unintentionally escape. Since a plurality of powder particles may block each other in the passages, even a very fine powder can be retained by the mesh, when no additional pressure is applied for instance by compressing the squeezable container. The mesh can be made from a metallic and/or plastic material. Preferably the mesh is manufactured by weaving one or more wires but can be also produced by perforating a disc.

Preferably the passages comprise an average distance s to each other of 0.05 mm≤s≤0.50 mm, particularly 0.10 mm≤s≤0.40 mm, preferably 0.15 mm≤s≤0.30 mm and most preferred 0.20 mm≤s≤0.25 mm. The average distance is the arithmetic average of all distances perpendicular outwards to the tangent for each point of the perimeter of the respective passage, wherein points leading to infinite distances are disregarded. Due to the comparatively small distance between neighboring passages the part between the passages provides the effect of a blade for cutting agglomerated powder particles in several parts. Powder particle agglomerates can be pulverized to very small particle sizes leading to a very fine dispensed powder cloud. The mesh can be produced by perforating a disc, wherein the perforations are spaced to each other by the above mentioned distance s. Preferably the mesh is manufactured by weaving one or more particularly metal and/or plastic wires, wherein the wires particularly comprises a diameter in the above mentioned range for the distance s.

Particularly the mesh is provided inside the cap only. It is not necessary to provide the mesh inside the outlet conduit. A backwater effect inside the outlet conduit is prevented. The mesh can be located in direct contact to a distal border wall of the cap, so that particularly an inlet curvature can start in flow direction of the dispensed powder directly behind the mesh. The distal border wall is a portion of the cap which provides a stop in flow direction of the outlet conduit so that a maximum distal end position of a part abutting the distal border wall is defined. The distal border wall may provide an abutting surface pointing in proximal direction, this means opposite to the flow direction. The abutting surface may point towards the container in assembled state of the container and the nozzle. The distal border wall with the abutting surface may be located inside the nozzle particularly for abutting the mesh and/or outside the nozzle particularly for abutting the container.

Preferably the mesh is provided spaced in axial direction to the outlet conduit particularly by means of a distance ring. Due to the defined distance between the mesh and the outlet conduit a volume directly after the mesh is provided, where the powder particle can provide a powder cloud with regularly distributed powder particles before being dispensed via the outlet conduit. Accumulations or agglomerations of powder particles due to concentration differences particularly inside the outlet conduit can be prevented or at least reduced.

Particularly preferred a first mesh is provided in direct contact to a distal border wall of the cap and a second mesh is provided spaced in axial direction to the first mesh particularly by means of a distance ring. If so, a third mesh or more meshes or a sieve or more than one sieve can be provided. By means of the several meshes a multiple stage pulverization of powder agglomerates can be provided. The hydraulic diameter of the passages of different meshes can be mainly identical or different. Particularly the passages of the subsequent mesh in flow direction of the dispensed powder comprise a smaller hydraulic diameter than the passages of the previous mesh or sieve. Further the powder retaining effect is increase by the plurality of meshes.

In another preferred embodiment of the invention at least one stabilization rip protruding from the outlet conduit and connected to the cap for stabilizing the outlet conduit is provided. Due to the at least one, particularly three, preferably four or more stabilization rips the stability of the outlet conduit is increased. It can be prevented that the steep outlet conduit may be bended, damaged, folded or broken. A proper course of the outlet conduit can be safeguarded and the risk that a clogging due to irregularities in the course of the outlet conduit may occur is at least reduced.

Preferably the mesh is connected inside the nozzle by bonding by means of an adhesive and/or by clamping by means of friction and/or by clipping by means of a clip connector and/or by welding particularly by ultrasonic welding. This leads to a secure connection of the mesh with the nozzle, which can be easily performed during the manufacturing process of the nozzle. The mesh can be connected via its peripheral surface and/or via a part of one of its front faces. If so, a provided distance ring can be connected inside the nozzle by bonding by means of an adhesive and/or by clamping by means of friction and/or by clipping by means of a clip connector and/or by welding particularly by ultrasonic welding. Further the at least one mesh can be connected to the distance ring by bonding by means of an adhesive and/or by clamping by means of friction and/or by clipping by means of a clip connector and/or by welding particularly by ultrasonic welding.

The invention further relates to a powder dispenser for applying a powder, particularly a pulverized hair treatment product, comprising a container partially filled with the powder, wherein the container is adapted to change its volume upon pressing on the container and wherein the container comprises an opening for filling in the powder closed by a nozzle, which can be designed as previously described. The container is particularly adapted to change its volume, when a pressure is applied from any direction. Preferably the container is squeezable and/or comprises flexible bellows. Due to the mesh powder agglomerates can be pulverized ensuring a very fine powder with small particle sizes. Since the mesh not only retains the powder particles but also pulverizes powder agglomerates, a homogenous particle size distribution of the dispensed powder particles can be ensured. Due to the small inclination angle $\alpha$ a steep course of the inner surface of the outlet conduit is given leading to an increased flow velocity at a reduced risk of accumulations and agglomerations of the powder particles. Due to the reduced amount of agglomerations inside the outlet conduit the risk of clogging is reduced when a powder is dispensed. The powder dispenser can be further designed as previously described with respect to the nozzle. The volume V of the container is particularly filled with the powder by $1\% \leq V \leq 90\%$, preferably $5\% \leq V \leq 60\%$, more preferred $10\% \leq V \leq 50\%$ and most preferred $15\% \leq V \leq 40\%$.

Particularly 90% of the volume of the powder comprises an average particle diameter $d_P$ of $1.0\ \mu m \leq d_P \leq 240\ \mu m$ particularly $2.0\ \mu m \leq d_P \leq 175\ \mu m$, preferably $3.0\ \mu m \leq d_P \leq 150\ \mu m$ and most preferred $4.0\ \mu m \leq d_P \leq 125\ \mu m$. Due to this average particle diameter of the powder a fine dispensed powder cloud can be provided, wherein at the same time an unintentionally escaping of the powder out of the container trough the mesh is at least unlikely.

Preferably the maximum volume of a 1 μm broad class of average particle diameters $d_{max}$ is at $3.0\ \mu m \leq d_{max} 60\ \mu m$, preferably $4.0\ \mu m \leq d_{max} \leq 20\ \mu m$, more preferred $6.0\ \mu m \leq d_{max} \leq 12\ \mu m$ and most preferred $8.0\ \mu m \leq d_{max} \leq 10\ \mu m$. A basic material refined to such kind of a reduction ratio leads to a distribution of particle sizes of the powder which leads to a fine dispensed powder cloud, wherein an unintentionally escaping of the powder out of the container trough the mesh can be prevented or at least reduced.

Particularly the container, particularly the material of the container and/or a wall thickness of the container, is chosen such that when 50% of the volume of the container is filled with the powder and the opening of the container is positioned vertically downwards a mass m of powder of $0.001\ g \leq m \leq 0.5\ g$, particularly $0.01\ g \leq m \leq 0.45\ g$, preferably $0.02\ g \leq m \leq 0.4\ g$, more preferred $0.05\ g \leq m \leq 0.3\ g$, further preferred $0.1\ g \leq m \leq 0.2\ g$ and most preferred $m = 1.0\ g \pm 0.02\ g$ is dispensed. In most cases this amount of mass of the powder is sufficient for covering the head of a person. The amount by which the volume of the container can be changed by pressing the container is adapted to an intended mass of the powder which should be applied. This result can be reached by adapting the design of the container. For example it is possible choosing a non-rigid and/or flexible material like PP or PE and adapting the wall thickness of container until the intended mass to be applied is reached. Further the form of the container can be adapted for providing a higher or lower amount for changing the volume of the container by pressing without changing the material or the wall thickness of the container.

The invention further relates to a use of a nozzle, which may be designed as previously described, and/or of a powder dispenser, which may be designed as previously described, for dispensing powder agglomerates, particularly a pulverized hair treatment product. The nozzle and/or the powder dispenser can be further used for dispensing powder agglomerates of a cosmetical and/or pharmaceutical and/or dermatological product. The nozzle is particularly used for applying a non-therapeutic product. The nozzle and/or the powder dispenser can be particularly used for applying the pulverized powder agglomerates to the head, particularly the hair and/or head skin, of a person.

In the following the invention is explained in detail by example with reference to the enclosed drawings showing preferred embodiments of the present invention.

In the drawings

Figure 2:
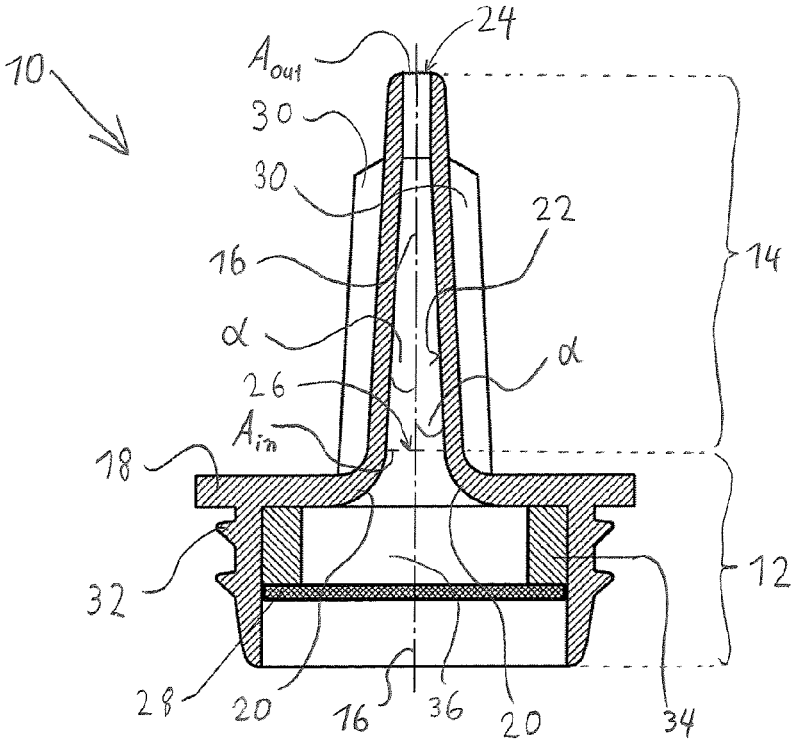
Figure 3:
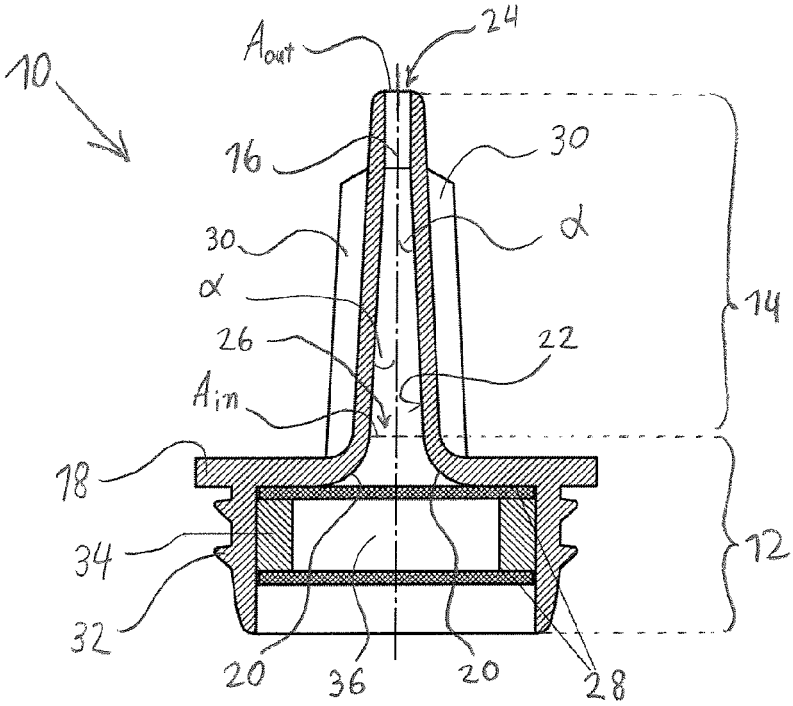
Figure 4:
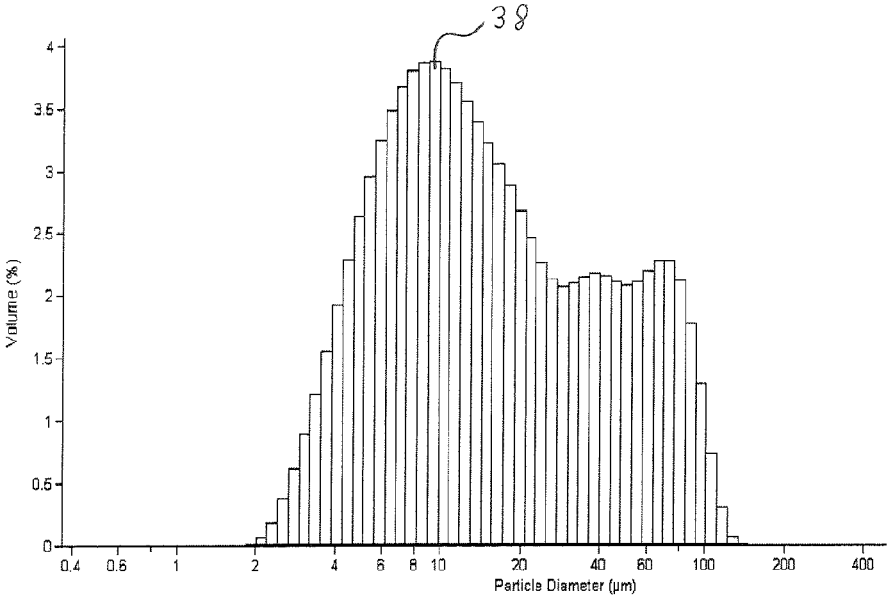
Figure 5:
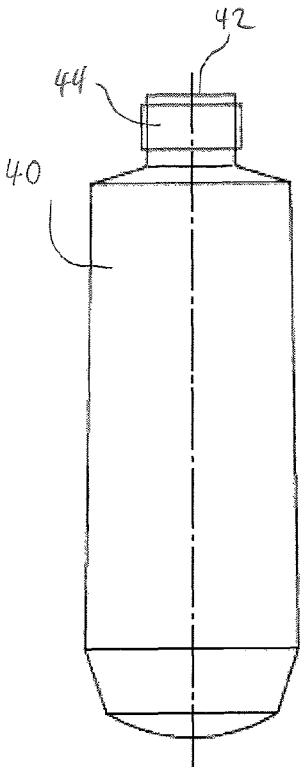
Figure 6:
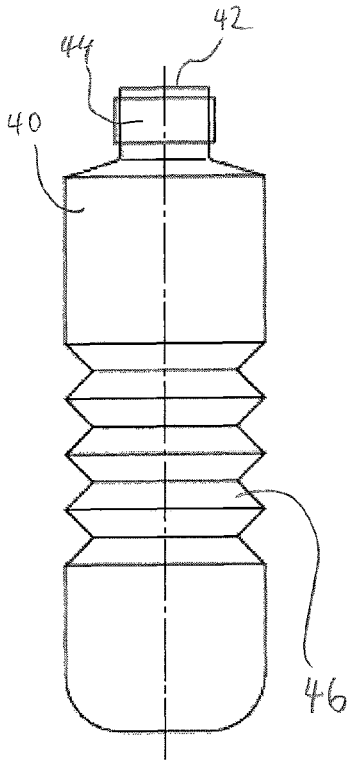
Figure 7:
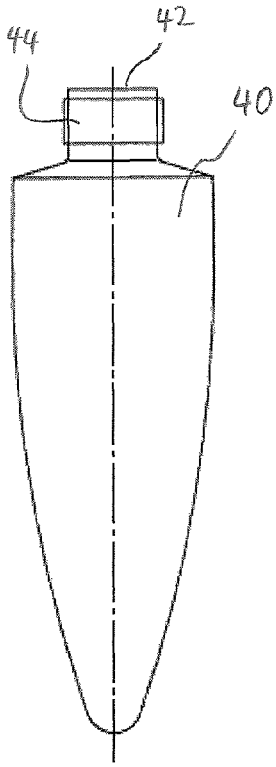
Figure 8:
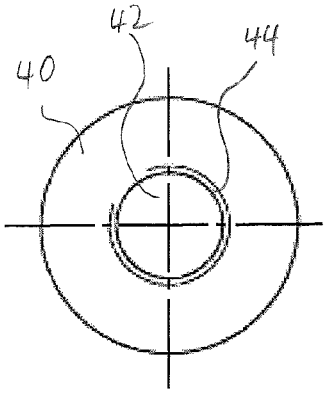
Figure 9:
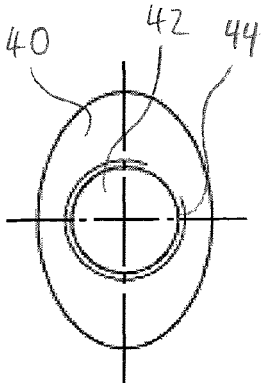
Figure 10:
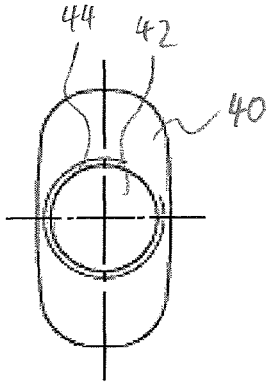

FIG. 1: is a sectional side view of a first embodiment of a nozzle,

FIG. 2: is a sectional side view of a second embodiment of a nozzle,

FIG. 3: is a sectional side view of a third embodiment of a nozzle,

FIG. 4: is a diagram of a volumetric particle size distribution of a powder, FIG. 5: is a schematic side view of a first embodiment of a container suitable for being connected to a nozzle illustrated in FIGS. 1 to 3, FIG. 6: is a schematic side view of a second embodiment of a container suitable for being connected to a nozzle illustrated in FIGS. 1 to 3, FIG. 7: is a schematic side view of a third embodiment of a container suitable for being connected to a nozzle illustrated in FIGS. 1 to 3, FIG. 8: is a schematic top view of a first embodiment of a container illustrated in FIGS. 5 to 7, FIG. 9: is a schematic top view of a second embodiment of a container illustrated in FIGS. 5 to 7, and FIG. 10: is a schematic top view of a third embodiment of a container illustrated in FIGS. 5 to 7.

The nozzle 10 as illustrated in FIG. 1 comprises a cap 12, from which an outlet conduit 14 protrudes in an axial direction 16. The cap 12 and the outlet conduit 14 are one-piece in the illustrated embodiment and particularly made by plastic injection molding. The cap 12 comprises a distal border wall 18 with an inlet curvature 20 whose inner surface merges stepless with a mainly linear inner surface 22 of the outlet conduit 14. The transition between the curved part of the inlet curvature 20 and the linear part of the inner surface 22 of the outlet conduit 14 defines the border between the cap 12 of the nozzle 10 and the outlet conduit 14 of the nozzle 10. The inner surface 22 of the outlet conduit 14 is stepless linear over the whole axial length of the outlet conduit 14. The inner surface 22 of the outlet conduit 14 is inclined with respect to the axial direction 16 by an angle $\alpha = 3°$, wherein the outlet area $A_{out}$ of an outlet opening 24 of the outlet conduit 14 is smaller than the inlet area $A_{in}$ of an inlet opening 26 of the outlet conduit 14.

The whole cross section of the outlet conduit 14 is covered by a mesh 28. In the illustrated embodiment the mesh 28 is in direct contact to the distal border wall 18 of the cap 12, so that in addition the whole cross section of the inlet curvature 20 is covered by the mesh 28. By means of the mesh 28 agglomerated powder particles of a not illustrated container can be pulverized when pressed through the mesh 28.

The outlet conduit 14 comprises due to the small angle α a steep and filigree design. The outlet conduit 14 is protected by means of stabilization rips 30 against bending or other possible damages. The stabilization rips 30 are provided along the main part of the axial extension of the outlet conduit 14. The stabilization rips 30 are connected to both the outlet conduit 14 and the distal border wall 18 of the cap 12. In the illustrated embodiment the cap 12 is provided with an external thread 32 for being securely screwed with a not illustrated container, which is partially filled with powder for being dispensed via the nozzle 10.

As illustrated in FIG. 2 the mesh 28 can be located spaced to the distal border wall 18 of the cap 12 by means of a distance ring 34. The distance ring 28 can for instance be inserted into the cap 12 by friction and/or bonded to the cap 12 by means of an adhesive. The distance ring 28 is particularly made from the same material as the nozzle 10. Between the mesh 28 and the distal border wall 18 a volume 36 is provided, where pulverized powder after passing the mesh 28 can be mainly regularly distributed before the pulverized powder is dispensed via the outlet conduit 14.

As illustrated in FIG. 3 the distance ring 34 can be provided on both front faces with meshes 28. Between the meshes 28 and the distance ring 34 a volume 36 is provided, where pulverized powder after passing the first mesh 28 can be mainly regularly distributed before the pulverized powder passes the next mesh 28.

In FIG. 4 the particle size distribution of a suitable powder is shown. The volume of the respective particle size in % is shown over the particle diameter in μm, wherein the particle diameters of the abscissa are shown logarithmically. Over 90% of the volume of the powder comprises a particle size between 2 μm and 120 μm. A 1 μm broad class 38 illustrating the volume amount of the particle sizes between 9 μm and 10 μm is with ca. 3.9% of the whole powder volume the maximum of the particle size distribution.

The container 40 as illustrated in FIG. 5 can be partially filled via an opening 42 with the powder comprising the particle size distribution as illustrated in FIG. 4. The container 40 can be connected to the nozzle 10 at its opening 42 for instance via an inner or outer thread 44. When the nozzle 10 is connected to the container 40 partially filled with a powder a powder dispenser is manufactured. The container 40 can be made from a compressible plastic material so that the container 40 is squeezable for discharging the received powder by reducing the filling volume of the container 40. The container 40 as illustrated in FIG. 6 comprises a flexible bellows 46 for reducing the filling volume of the container 40 for discharging the received powder. When the container is pressed from the bottom, the bellows 46 is folded reducing the volume of the container 40. Due to the increased pressure inside the reduced volume of the container 40 the powder is discharged via the opening 42 and the nozzle 10 outwards. In this embodiment the bellows 46 is sufficient for discharging the received powder so that the remaining container 40 may be rigid. The shape of the container 40 can be differently formed for example at its upper half and its lower half as illustrated in FIG. 7. The shape of the container 40 may be designed with respect to an optimization of an ergonomic handling of the container 40. The container 40 may comprise a cross section, which is circular (FIG. 8), elliptic (FIG. 9), rectangular with rounded corners (FIG. 10) or of any other suitable design.

The invention claimed is:

1. A nozzle for applying a powder, the nozzle comprising:

a cap for being connected to a squeezable container for storing the powder, wherein the cap comprises a distal border wall and an outer thread for being screwed onto the squeezable container, wherein the outer thread extends outwardly with respect to the distal border wall and the cap has an interior space defined by the distal border wall and the outer thread;

an outlet conduit protruding from the cap along an axial direction for dispensing the powder through the cap, wherein the outlet conduit comprises an inner surface for guiding the powder; and a mesh covering the outlet conduit for retaining the powder and adapted to pulverize powder agglomerates, wherein the mesh, in its entirety, is positioned within the interior space of the cap, and further wherein the mesh is a web of woven wires comprising passages arranged at least in a region covering the outlet conduit, wherein the inner surface of the outlet conduit is inclined with respect to the axial direction of the outlet conduit by an angle α of $0.0° < \alpha \leq 15.0$, and further wherein the sum $A_P$ of the areas of the passages of the mesh is higher than the sum $A_M$ of the areas of the parts between the passages in flow direction, wherein the ratio $A_P/A_M$ is $3 \leq A_P/A_M \leq 100$.

2. The nozzle according to claim 1, wherein the inner surface of the outlet conduit is steplessly inclined with respect to the axial direction of the outlet conduit and comprises a constant angle α.

3. The nozzle according to claim 1, wherein the outlet conduit comprises, at its distal end, an outlet opening comprising a cross sectional area of $A_{out}$ and, at its proximal end, an inlet opening comprising a cross sectional area of $A_{in}$, wherein, in the case of a present inlet curvature, the inlet opening is located at a change between the inlet curvature and a mainly linear course of the inner surface of the outlet conduit, wherein the ratio between $A_{out}$ and $A_{in}$ is $0.0 < A_{out}/A_{in} \leq 1.0$.

4. The nozzle according to claim 1, wherein the outlet conduit comprises, at its distal end, an outlet opening comprising a hydraulic diameter $d_{out}$ of $0.3\ mm \leq d_{out} \leq 2.0\ mm$.

5. The nozzle according to claim 1, wherein each of the passages of the mesh in the region covering the outlet conduit comprises a hydraulic diameter d of $0.01\ mm \leq d \leq 0.45\ mm$.

6. The nozzle according to claim 1, wherein the mesh is spaced in axial direction to the outlet conduit by means of a distance ring.

7. The nozzle according to claim 1, wherein the mesh is provided in direct contact to the distal border wall of the cap and an additional mesh is spaced in axial direction to the outlet conduit by means of a distance ring.

8. The nozzle according to claim 1, wherein at least one stabilization rip, protruding from the outlet conduit and connected to the cap for stabilizing the outlet conduit, is provided.

9. The nozzle according to claim 1, wherein the mesh is connected inside the nozzle by bonding by means of an adhesive and/or by clamping by means of friction and/or by clipping by means of a clip connector and/or by ultrasonic welding.

10. A powder dispenser for applying a powder, the powder dispenser comprising a container partially filled with the powder, wherein the container is adapted to change its volume upon pressing on the container and wherein the container comprises an opening for filling in the powder closed by the nozzle according to claim 1.

11. The powder dispenser according to claim 10, wherein 90% of the volume of the powder comprises an average particle diameter $d_p$ of 1.0 μm≤$d_p$≤240 μm.

12. The powder dispenser according to claim 10, wherein a volume V of the container is filled with the powder by 1%≤V≤90%.

13. The powder dispenser according to claim 10, wherein the material of the container and/or a wall thickness of the container is chosen such that when 50% of the volume of the container is filled with the powder and the opening of the container is positioned vertically downwards a mass m of powder of 0.001 g≤m≤0.5 g is dispensed.

14. The powder dispenser according to claim 10, wherein the inner surface of the outlet conduit is inclined with respect to the axial direction of the outlet conduit by an angle α of 2.0°<α≤7.0°.

15. The powder dispenser according to claim 14, wherein the inner surface of the outlet conduit is inclined with respect to the axial direction of the outlet conduit by an angle α of 2.5°<α≤6.0°.

16. The powder dispenser according to claim 10, wherein the inner surface of the outlet conduit is inclined with respect to the axial direction of the outlet conduit by an angle α of 3.0°±0.2°.

17. The nozzle according to claim 1, wherein the passages of the mesh have an average distance s to each other of 0.20 mm≤s≤0.25 mm.

18. The nozzle according to claim 1, wherein the woven wires are made from at least one selected from metal material and plastic material.

19. A nozzle for applying a powder, the nozzle comprising:

a cap for being connected to a squeezable container for storing the powder, wherein the cap comprises a distal border wall and an outer thread for being screwed onto the squeezable container, wherein the outer thread extends outwardly with respect to the distal border wall, and further wherein the cap comprises an interior space defined by the distal border wall and the outer thread;

an outlet conduit protruding from the cap along an axial direction for dispensing the powder through the cap; and a mesh covering the outlet conduit for retaining the powder and for pulverizing powder agglomerates, wherein the mesh, in its entirety, is positioned within the interior space of the cap, further wherein the mesh comprises passages arranged at least in a region covering the outlet conduit, wherein the outlet conduit has an inner surface that is stepless, wherein a first portion of the inner surface is inclined with respect to the axial direction of the outlet conduit by an angle α of 0.0°<α≤15.0°, wherein the first portion of the inner surface has an entire length defined between a first end and a second end and is linear along the entire length of the first portion of the inner surface, wherein a second portion of the inner surface is parallel with respect to the axial direction of the outlet conduit, and further wherein the first portion of the inner surface is located between the mesh and the second portion of the inner surface and the entire length of the first portion is greater than an entire length of the second portion that is defined between a first end and a second end of the second portion of the inner surface.

20. The nozzle according to claim 1, wherein the mesh has a side edge extending around the entire circumference of the mesh, and further wherein the entire side edge of the mesh directly contacts an interior surface of the outer thread.

21. The nozzle according to claim 20, wherein the mesh directly contacts the distal border wall of the cap.

22. The nozzle according to claim 20, wherein the mesh has a total thickness extending within the circumference of the mesh, and further wherein the total thickness of the mesh is continuous and planar within the circumference.

* * * * *